United States Patent [19]

Tachibana et-al.

[11] Patent Number: 4,878,279

[45] Date of Patent: Nov. 7, 1989

[54] WARP TRANSFER APPARATUS

[75] Inventors: Juro Tachibana, Matsuyama; Yoshihide Nishimura, Iyo, both of Japan

[73] Assignee: Teijin Seiki Company Limited, Osaka, Japan

[21] Appl. No.: 204,122

[22] Filed: Jun. 8, 1988

[30] Foreign Application Priority Data

Oct. 22, 1987 [JP] Japan ..... 62-160843

[51] Int. Cl.[4] ..... D03J 1/14

[52] U.S. Cl. ..... 28/203

[58] Field of Search ..... 28/201, 202, 203, 204, 28/205, 206, 207, 208

[56] References Cited

U.S. PATENT DOCUMENTS 1,342,896 6/1920 Colman et al. ..... 28/202
1,716,549 6/1929 Hammer ..... 28/202
4,723,346 2/1988 Tachibana et al. .

FOREIGN PATENT DOCUMENTS 348937 10/1960 Switzerland .
593660 10/1947 United Kingdom .

*Primary Examiner*—Robert R. Mackey
*Attorney, Agent, or Firm*—Cushman, Darby & Cushman

[57] ABSTRACT

A warp transfer apparatus for transferring warp threads to a warp drawing apparatus, comprising a stationary frame structure, a warp carrying frame structure for carrying the warp threads thereon which is movable with respect to the stationary frame structure and which has mounted thereon a rack extending along a direction in which the warp carrying frame structure moves, a pinion support rotatably supported on the stationary frame structure, a pinion rotatably supported on the pinion support and engageable with the rack, means for driving the pinion to rotate about an axis of rotation of the pinion, the warp carrying frame structure being transferred to a predetermined position of the stationary frame structure by rotation of the pinion, means for rotating the pinion support in accordance with upward and downward movements of the rack during movement of the warp carrying frame structure, with the condition the rack is properly engaged by the pinion.

6 Claims, 4 Drawing Sheets

V
V 51a
50
51
51b
55(56)
31
27(28)
25
IV
60
53(54)
29
VI
61
33
39
52
32
64
22
30
59
23
65
57a
66
62
57
58
47
65a
63
26
67
VI
46
49
20
48
3'
IV

WARP TRANSFER APPARATUS

FIELD OF THE INVENTION

The present invention relates in general to a warp transfer apparatus, and in particular to an apparatus for transferring warp threads to a warp drawing apparatus in which the warp threads are drawn through eyes of the heddles for a loom.

DESCRIPTION OF THE PRIOR ART

In a warp drawing apparatus, in which the warp threads are drawn through eyes of the heddles for a loom, there is provided a warp transfer apparatus including a warp carrying frame for carrying warp threads thereon. The warp carrying frame is moved in a direction, wherein the warp threads are arranged, and transferred to a position in which the warp threads are drawn in by the warp drawing apparatus.

In the warp transfer apparatus of the type above described, there are provided a rack mounted on the warp carrying frame and a pinion engaged with the rack, and the warp carrying frame is moved by rotating the pinion by a pinion drive unit.

However, in such a conventional warp transfer apparatus, the pinion drive unit is mounted on a fixed frame of the warp drawing apparatus, the height of the pinion is fixed with respect to the floor on which the fixed frame of the warp drawing apparatus is mounted, and the pinion is constructed so as to engage with the rack of the warp carrying frame that moves on the floor. For this reason, the rack tends to be moved upward and downward because of irregularities of the surface of the floor during movement of the warp carrying frame, and therefore the depth of the engagement of the pinion with the rack changes. If the depth of the engagement is changed, the distance of movement of the warp carrying frame is varied and thus an accuracy of movement of the warp carrying frame is reduced, because the warp carrying frame carries a warp beam on which the warp threads are wound and is about 1000 kg at maximum and thus very heavy, and furthermore because the distance of movement of the warp carrying frame is about 1 to 2 m/minute and thus very small. Thus, the conventional warp apparatus has the drawback that the warp threads cannot be transferred precisely to a predetermined position if the rack is moved upward and downward. Furthermore, in order to maintain constant the depth of the engagement of the pinion with the rack to improve the accuracy of movement of the warp carrying frame, the floor is required to be smoothly finished and therefore the installation cost for the apparatus is increased.

Accordingly, the object of the present invention is to provide an improved warp transfer apparatus in which the accuracy of movement of the warp carrying frame structure is assured independently of the irregularities of the floor and in which the installation cost for the apparatus is reduced.

SUMMARY OF THE INVENTION

The foregoing object is accomplished in accordance with the present invention by providing a warp transfer apparatus for transferring warp threads to a warp drawing apparatus, comprising a stationary frame structure, a warp carrying frame structure for carrying the warp threads thereon which is movable with respect to the stationary frame structure and which has mounted thereon a rack extending along a direction in which the warp carrying frame structure moves, a pinion support pivotably supported on the stationary frame structure, a pinion rotatably supported on the pinion support and engageable with the rack, means for driving the pinion to rotate about an axis of rotation of the pinion, the warp carrying frame structure being transferred to a predetermined position of the stationary frame structure by rotation of the pinion, means for permitting pivotal movement of the pinion support in accordance with upward and downward movements of the rack during movement of the warp carrying frame structure, with the condition the rack is properly engaged by the pinion.

The foregoing object is also accomplished in accordance with the present invention by providing a warp transfer apparatus for transferring warp threads to a warp drawing apparatus, comprising a stationary frame structure, a warp carrying frame structure for carrying the warp threads thereon which is movable with respect to the stationary frame structure and which has mounted thereon a rack extending along a direction in which the warp carrying frame structure moves, a pinion support pivotably supported on the stationary frame structure, a pinion rotatably supported on the pinion support and engageable with the rack, means for driving the pinion to rotate about an axis of rotation of the pinion, the warp carrying frame structure being moved to a predetermined position of the stationary frame structure by rotation of the pinion, a lever pivotably supported to the pinion support and having rotatably mounted thereon a roll which is arranged in facing relationship with the pinion, means connected to the pinion support and the lever and for pivoting the pinion support and the lever in such a manner that the pinion and the roll are moved toward and away from each other, and an elastic member interposed between the stationary frame structure and the pinion support and for regulating the pivotal movement of the pinion support, the pinion support being pivoted, with the rack held by the pinion and the roll, in accordance with upward and downward movements of the rack by deformation of the elastic member during movement of the warp carrying frame structure.

BRIEF DESCRIPTION OF THE DRAWINGS

The features and advantages of a warp transfer apparatus according to the present invention will be more clearly understood from the following description taken in conjunction with the accompanying drawings in which.

DETAILED DESCRIPTION OF THE PREFERRED EMBODIMENTS

Figure 1:
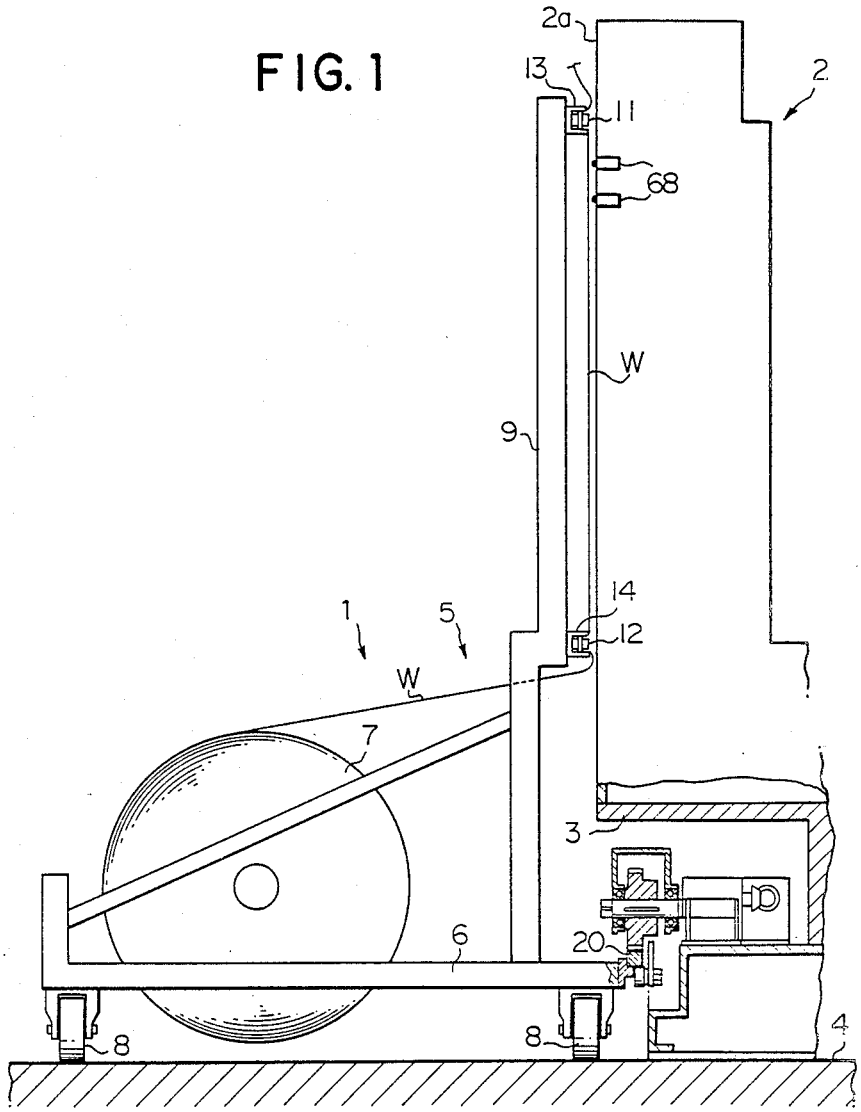
FIG. 1 is a fragmentary side elevational view showing a warp transfer apparatus according to the present invention and a part of a warp drawing apparatus to which the warp threads are transferred by the warp transfer apparatus.

Referring now in detail to the drawings and initially to FIG. 1, there is shown a warp transfer apparatus generally designated by reference numeral 1. The warp transfer apparatus 1 is provided in the vicinity of the front face 2*a* of a warp drawing apparatus 2 wherein warp threads are drawn through eyes of the heddles for a loom. The warp drawing apparatus 2 is mounted through a stationary frame structure 3 on a floor 4. The warp transfer apparatus 1 according to the present invention comprises a warp carrying frame structure 5 including a movable base frame 6 on which a warp beam 7 is mounted. The movable base frame 6 has a plurality of rolls 8 carried thereon and is movable in a longitudinal direction indicated by the arrow X in FIG. 2 along the front face 2*a* of the warp drawing apparatus 2. The warp carrying frame structure 5 further includes a warp frame 9 extending upward from the base frame 6 and carrying in the longitudinal direction X a mass or pack of warp threads W through warp-holding upper and lower members 11 and 12 respectively mounted in upper and lower channel beams 13 and 14.

Figure 2:
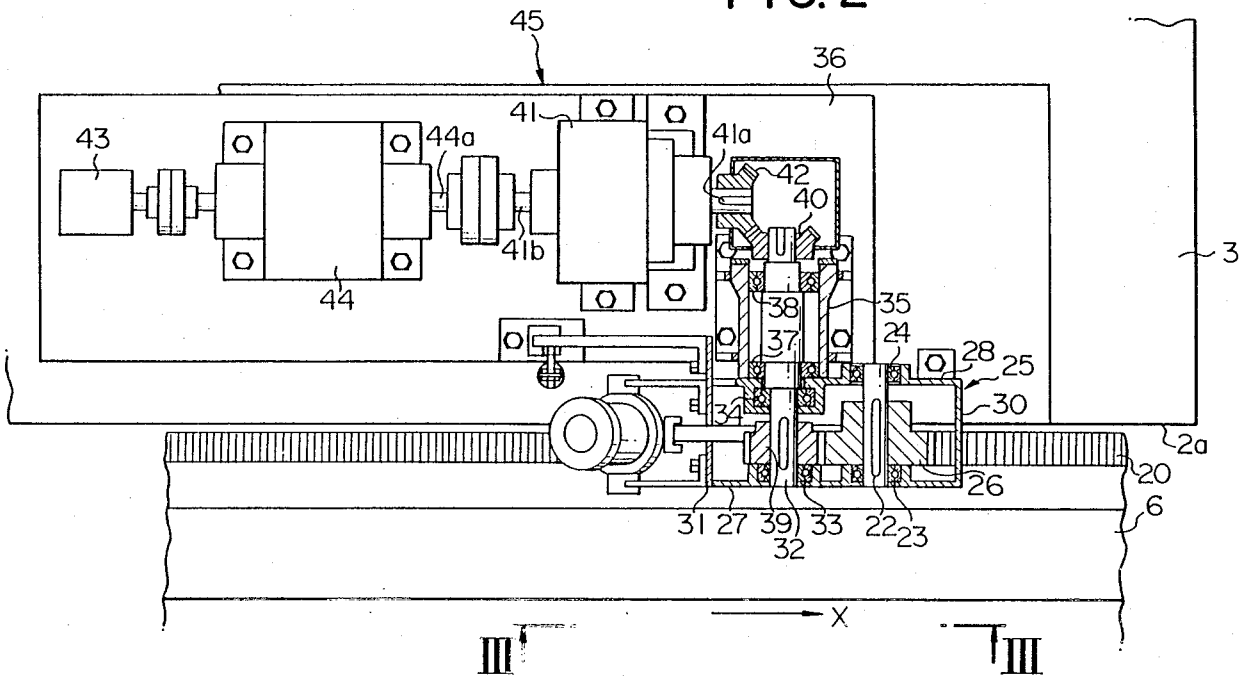
FIG. 2 is a fragmentary plan view showing the warp transfer apparatus shown in FIG. 1.
Figure 3:
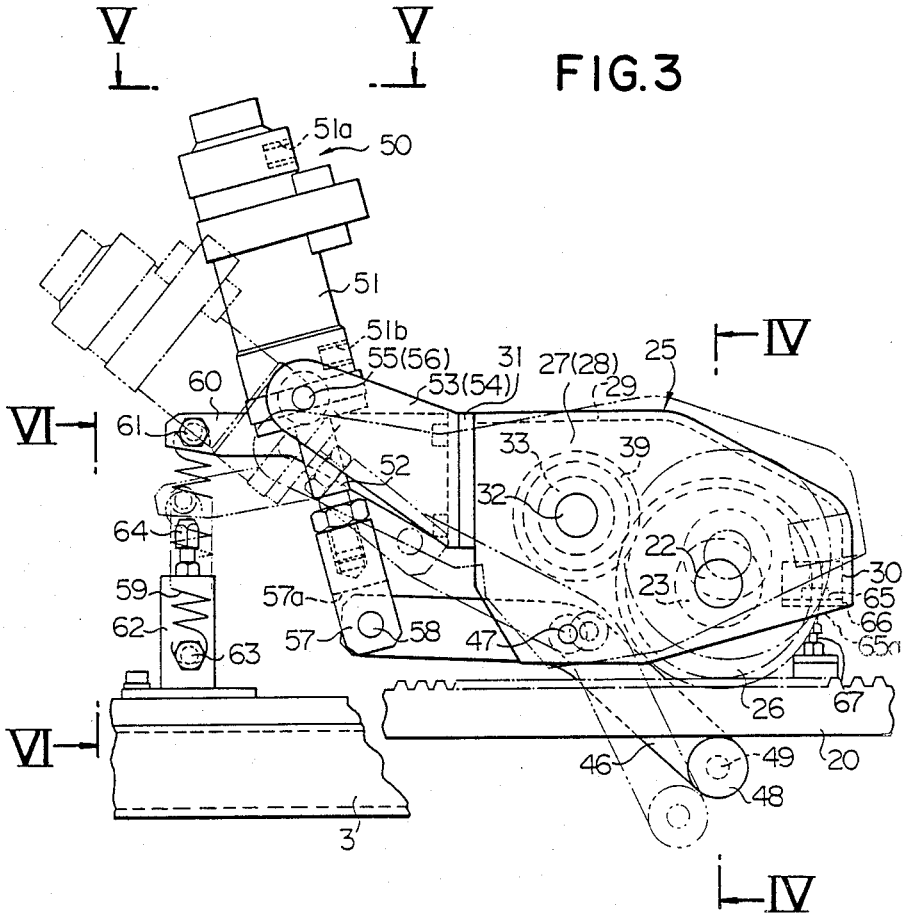
FIG. 3 is an enlarged side view taken substantially along line III—III in FIG. 2.
Figure 4:
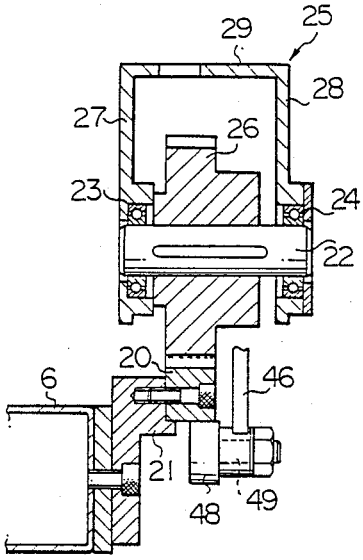
FIG. 4 is a sectional view, taken substantially along line IV—IV in FIG. 3, illustrating the pinion and rack of the warp transfer apparatus.

In FIGS. 3 and 4, a rack denoted by reference numeral 20 extends, as shown in FIG. 2, in the longitudinal direction of the base frame 6 of the warp carrying frame structure 5, i.e., in the direction X in which the warp carrying frame structure 5 moves, and the rack 20 is fixedly mounted to the base frame 6 through a bracket member 21 as clearly shown in FIG. 4. The rack 20 is engaged by a pinion 26 which is nonrotatably mounted on a pinion shaft 22 which in turn is freely rotatably supported through front and rear bearings 23 and 24 to a pinion support 25. Thus, the pinion 26 is freely rotatably supported by the pinion support 25. The pinion support 25 comprises a pair of front and rear plates 27 and 28 in which the front and rear bearings 23 and 24 are respectively mounted, an upper plate 29 extending between the front and rear plates 27 and 28 and covering the upper ends of the front and rear plates 27 and 28, and a pair of side plates 30 and 31 (FIG. 3). As shown in FIG. 2, the pinion support 25 is freely pivotably supported through bearings 33 and 34 on one end of an intermediate shaft 32 which passes through the front and rear plates 27 and 28 of the pinion support 25. In FIG. 2, a bearing housing designated by reference numeral 35 is provided on a common bed 36 fixedly mounted on the stationary frame structure 3 of the warp drawing apparatus 2, and the intermediate shaft 32 is freely rotatably supported through bearings 37 and 38 of the bearing housing 35. Thus, the pinion support 25 is pivotable about the intermediate shaft 32 with respect to the stationary frame structure 3 of the warp drawing apparatus 2. The intermediate shaft 32 has an intermediate gear 39 mounted on one end thereof between the bearing 33 and 34, and has a driven bevel gear 40 mounted on the other end thereof. The intermediate gear 39 is engaged by the pinion 26, which the driven bevel gear 40 is engaged by a drive bevel gear 42 which is mounted on the output shaft 41*a* of a clutch brake 41 having a center axis perpendicular to the center axis of the intermediate shaft 32. The clutch brake 41 has at the opposite side of the output shaft 41*a* an input shaft 41*b* which is coupled to the output shaft 44*a* of a reduction gear 44 which is driven by means of a motor 43. The rotation of the motor 43 is reduced by the reduction gear 44 and transmitted to the clutch brake 41. When the clutch mechanism (not shown) provided in the clutch brake 41 is in the operating position, the rotation of the motor 33 reduced by means of the reduction gear 44 is transmitted through the clutch brake 41, drive bevel gear 42, driven bevel gear 40 and through the intermediate gear 39 to the pinion 26, and the rack 20 is driven by rotation of the pinion 26, so that the warp carrying frame structure 5 is caused to move in the longitudinal direction X. After the warp carrying frame structure 5 is moved to a predetermined position along the front face 2*a* of the warp drawing apparatus 2, the clutch mechanism of the clutch brake 41 is released and at the same time the rotation of the output shaft 41*a* of the clutch brake 41 is stopped by means of the brake (not shown) of the clutch brake 41, and therefore the movement of the warp carrying frame structure 5 is brought into a stop concurrently with the release of the clutch mechanism. The aforementioned motor 43, reduction gear 44, clutch brake 41, drive bevel gear 42, driven bevel gear 40, intermediate shaft 32, bearing housing 35 and intermediate gear 39 as a whole constitute pinion drive means 45 which is adapted to drive the pinion 26 and which is fixedly mounted on the common bed 36 on the stationary frame structure 3 of the warp drawing apparatus 2.

In FIG. 3, a rack holding lever denoted by reference numeral 46 is freely rotatably supported through its pin 47 to the pinion support 25. The rack holding lever 46 has at its one end a rack holding roll 48 which is engageable with the rack 20 and which is freely rotatably supported on a pin 49 fixed to the lever 46. An actuator 50 comprising a cylinder 51 and a piston rod 52 fixed to the piston (not shown), is connected to the other end of the rack holding lever 46 and to the pinion support 25, and serves as drive means which drives the rack holding lever 46 and the pinion support 25 to pivot about the pin 47 and about the intermediate shaft 32, respectively, in such a manner that the rack holding roll 48 and the pinion 26 are moved toward and away from each other. As clearly shown in FIG. 5, the actuator 50 is connected to the side plate 31 of the pinion support 25 through a pair of bracket members 53 and 54 which are respectively pivotably supported at one ends thereof on pins 55 and 56 projecting from the actuator 50 and which are respectively fixed at the other ends thereof to the side plate 31 of the pinion support 25 by means of bolts 53*a* and 54*a*. On the piston rod 52 of the actuator 50 is threaded a cylindrical connection member 57 which is formed with a groove 57*a* in which the other end of the rack holding lever 46 is inserted. The actuator 50 is connected to the rack holding lever 46 through the connection member 57 and through a connection pin 58 which is passed through apertures formed in the connection member 57 and which is also passed through an aperture formed in the other end of the rack holding lever 46. The cylinder 51 of the actuator 50 is provided with a pair of inlet ports 51*a* and 51*b* through which working fluid, for example, air or oil under pressure is supplied to one or the other cylinder chamber (not shown) arranged across the piston of the cylinder. The admission of the working fluid to one or the other cylinder chamber causes the piston rod 52 to project from and retract into the cylinder 51. Therefore, the pinion support 25 and the rack holding lever 46 are pivoted by the movement of the piston rod 52 of the actuator 50. More particularly, since the pinion support 25 pivotable on the intermediate shaft 32 is connected to the pin 55 of the actuator 50 and since the rack holding lever 46 pivotable on the pin 47 is connected to the connection pin 58 of the piston rod 52, if the distance between the pins 55 and 58 is decreased, the pinion support 25 and the rack holding roll 48 are pivoted away from each other, and on the other hand, if the distance between the pins 55 and 58 is increased, the pinion support 25 and the rack holding roll 48 are pivoted toward each other. Namely, if the piston rod 52 projects from the cylinder 51, the rack holding roll 48 and the pinion 26 supported by the pinion support 25 are moved toward each other as shown by the solid lines in FIG. 3 and hold the rack 20 therebetween. If, on the other hand, the piston rod 52 retracts into the cylinder 51, the rack holding roll 48 and the pinion 26 are moved away from each other as shown by the broken lines in FIG. 3.

Figure 6:
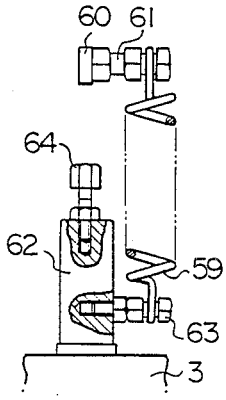
FIG. 6 is a fragmentary end view taken substantially along line VI—VI in FIG. 3.
Figure 5:
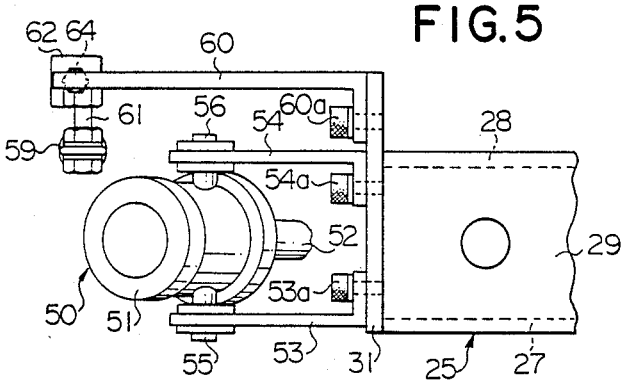
FIG. 5 is a fragmentary plan view taken substantially along line V—V in FIG. 3.

In FIG. 3, a coil spring denoted by reference numeral 59 is interposed between the stationary frame structure 3 of the warp drawing apparatus 2 and the pinion support 25. The coil spring 59 is urged such that the pinion support 25 is pivoted and the pinion 26 and the rack holding roll 48 are moved away from each other, and serves as an elastic member which regulates the pivotal movement of the pinion support 25. The upper end of the coil spring 59, as clearly shown in FIGS. 5 and 6, is connected through a connection bolt 61 to the fore end of a stop lever 60, which stop lever 60 extends parallel to the bracket 54 of the actuator 50 and is fixedly mounted at its rear end to the side plate 31 of the pinion support 25 by means of a bolt 60*a*, while the lower end of the coil spring 59 is connected through a connection bolt 63 to a post 62 fixedly mounted on the stationary frame structure 3 of the warp drawing apparatus 2. It is noted that the connection bolts 61 and 63 are threaded into the stop lever 60 and the post 62, respectively, and each project to the side of the actuator 50. A stop member 64 is provided in the upper end of the post 62, and as shown by the broken lines in FIG. 3, when the piston rod 52 of the actuator 50 is retracted into the cylinder 51 and therefore the rack holding roll 48 and the pinion 26 are moved away from each other, the pinion support 25 is pivoted upward by the coil spring 59, and the stop lever 60 of the pinion support 25 is brought into engagement with the stop member 64. As a result, the pinion support 25 is fixed and held by the coil spring 59, and thus the free pivotal movement of the pinion support 25 is limited. Namely, as previously indicated, the coil spring 59 functions to limit the pivotal movement of the pinion support 25. Furthermore, since the other end of the rack holding lever 46 is connected through the connection member 57 and through the connection pin 58 to the piston rod 52, if the movement of the piston rod 52 is stopped, the pinion support 25 is fixed and held and at the same time the rack holding lever 46 is automatically fixed and held. It is noted that, since the stop member 64 is threaded into the post 62, the rotation of the stop member 64 can adjust the position in which the pinion support 25 is fixed and held by the coil spring 59.

In FIG. 3, a proximity switch designated by reference numeral 65 is provided in the vicinity of the rear plate 28 of the pinion support 25 and fixed through a L-shaped bracket member 66 to the pinion support 25. A projection 67 is mounted on the stationary frame structure 3 of the warp drawing apparatus 2 in facing relationship with a lower end 65*a* of the proximity switch 65. The switch 65 serves to output a proximity signal, when the pinion support 25 is pivoted downward and the space between the lower end 65*a* of the proximity switch 65 and the projection 67 becomes 1 to 3 mm for example. If the piston rod 52 of the actuator 50 projects, the rack holding lever 46 is first pivoted upward and therefore the rack holding roll 48 is brought into engagement with the rack 20. The piston rod 52 further projects against the coil spring 59 to pivot the pinion support 25 toward the rack 20 so that the rack holding roll 48 and the pinion 26 are moved toward each other, and stops with the condition the pinion 26 is properly engaged with the rack 20. At the same time, the lower end 65*a* of the proximity switch 65 fixed to the pinion support 25 is moved downward toward the projection 67 and the space therebetween becomes the aforesaid dimension (1 to 3 mm), so that the proximity switch 65 outputs the proximity signal, thereby being able to confirm whether the rack 20 is held by the pinion 26 and the rack holding roll 48. It is noted that the amount of backlash between the pinion 26 and the rack 20 can be adjusted by adjusting in advance the distance that the piston rod 52 of the actuator 50 advances. Furthermore, with the rack 20 held by the rack holding roll 48 and the pinion 26 and with the pinion 26 held in meshing engagement with the rack 20, the pinion 26 is driven to rotate about its own axis by the pinion drive means 45. When the warp carrying frame structure 5 is moved together with the rack 20, the coil spring 59 is expanded as shown by the solid lines in FIG. 3 and the stop lever 60 of the pinion support 25 is moved away from the stop member 64. Therefore, even if the rack 20 is caused to move upward and downward because of the irregularities of the surface of the floor 4, the engagement of the pinion 26 with the rack 20 can be maintained properly due to the axial deformation of the coil spring 59, and the pinion support 25 can be pivoted upward and downward in accordance with the upward and downward movements of the rack 20 due to the axial deformation of the coil spring 59.

Returning to FIG. 1, a photoelectric switch 68 is provided in the upper end portion of the warp drawing apparatus 2 and comprises a projector part for projecting a ray of light on the warp threads W held between the upper and lower beams 13 and 14 of the warp carrying frame structure 5, and a receiver part for receiving the reflected ray of the warp thread W and converting it into a control signal. After the first one of the warp threads W, which are successively arranged in the longitudinal direction X along the front face 2*a* of the warp drawing apparatus 2, is drawn through the heddle eye by the warp drawing apparatus 2, the photoelectric switch 68 outputs the control signal to a control circuit (not shown) which controls the actuation of the pinion drive means 45. The control circuit outputs an actuation signal to the pinion drive means 45 in accordance with the control signal from the photoelectric switch 68, and actuates the clutch brake 41 of the pinion drive means 45 to drive the pinion drive means 45. Consequently, the pinion 26 is rotated about its own axis and the warp carrying frame structure 5 is moved through the rack 20 mounted on the structure 5. If the next warp thread W, which is arranged adjacent the warp thread W that has been drawn through the heddle eye, is advanced to the position of the projector part of the photoelectric switch 68, the photoelectric switch 68 receives the reflected ray of the warp thread W and again outputs the control signal to the control circuit. In accordance with the control signal, the control circuit outputs a stop signal to the pinion drive means 45, and the warp carrying frame structure 5 is stopped and held in a predetermined position of the stationary frame structure 3 of the warp drawing apparatus 2. Consequently, the warp thread W to be drawn through the heddle eye is properly positioned in the predetermined position. It is noted that an additional photoelectric switch 68 is provided against the fault of the aforesaid photoelectric switch 68. It is also noted that the aforesaid proximity switch 65 is connected to the control circuit above described, and that an interlock circuit is provided in the control circuit in order that the pinion drive means 45 is driven after the rack 20 is held by the pinion 26 and rack holding roll 48.

The operation of the warp transfer apparatus thus constructed will hereinafter be described in detail.

As shown in FIG. 1, the warp carrying frame structure 5 has a mass or pack of threads W wound around the warp beam 7, held between the upper and lower beams 13 and 14, and arranged in a longitudinal direction of the longitudinal center axis of the warp beam 7. The frame structure 5 is arranged so as to face the front face 2*a* of the warp drawing apparatus 2. At this time, as shown by the broken lines in FIG. 3, the piston rod 52 of the actuator 50 is retracted into the cylinder 51 by supplying the working oil to one of the cylinder chambers, and the pinion 26 and the rack holding roll 48 are moved away from each other, and furthermore, with the stop lever 60 of the pinion support 25 fixed and held on the stop member 64 by the coil spring 59, the warp carrying frame structure 5 is arranged such that the rack 20 of the warp carrying frame structure 5 is positioned between the pinion 26 and the rack holding roll 48. In addition, the first one of the warp threads W, which are held between the upper and lower warp beams 13 and 14 and arranged in the longitudinal direction, is positioned short of the photoelectric switch 68. After the warp carrying frame structure 5 is properly arranged, the piston rod 52 of the actuator 50 is projected by supplying the working oil to the other chamber, and as shown by the solid lines in FIG. 3, the pinion 26 and the rack holding roll 48 move toward each other to hold the rack 20 therebetween, and the pinion 26 is brought into meshing engagement with the rack 20. Thereafter, in FIG. 2, the motor 43 of the pinion drive means 45 is driven, and since the first one of the warp threads W longitudinally arranged is arranged short of the position of the photoelectric switch 68, the control circuit outputs the actuation signal to the pinion drive means 45 in accordance with the control signal from the photoelectric switch 68. In accordance with the actuation signal, the clutch mechanism of the clutch brake 41 is coupled, and the rotation of the motor 43 is reduced through the reduction gear 44 and transmitted through the clutch brake 41, drive bevel gear 42, driven bevel gear 40 and through the intermediate gear 39 to the pinion 26. The rack 20 engaged by the pinion 26 is then driven and therefore the warp carrying frame structure 5 advances in the direction indicated by the arrow X in FIG. 2.

The movement of the warp carrying frame structure 5 causes the warp thread W to approach the photoelectric switch 68. When the warp thread W is passed through a ray of light projected from the photoelectric switch 68, the switch 68 receives the reflected ray and outputs the control signal to the control circuit. In accordance with the control signal, the control circuit outputs the stop signal to the pinion drive means 45, and the connection of the clutch mechanism of the clutch brake 41 is released. At the same time, the output shaft 41*a* of the clutch brake 41 is braked and the movement of the warp carrying frame structure 5 is rapidly brought into a stop. At this time, since the backlash between the pinion 26 and the rack 20 is suitably maintained, the warp carrying frame structure 5 is accurately stopped to the predetermined position and positioned. Accordingly, the warp thread W to be drawn through the heddle eye is accurately transferred in the predetermined manner. After the warp thread W is drawn through the heddle eye by the warp drawing apparatus 2, the pinion drive means 45 is driven according to the signal of the photoelectric switch 68, and the warp carrying frame structure 5 is moved and stopped, so that the next warp thread is transferred to the predetermined position. The aforesaid process is repeated in order that all of the warp threads held by the warp carrying frame structure 5 are drawn through the heddle eyes by the warp drawing apparatus 2.

On the other hand, in the event the rack 20 is moved upward and downward because of the irregularities of the surface of the floor 4 during the movement of the warp carrying frame structure 5, the pinion support 25 can be pivoted in accordance with the upward and downward movements of the rack 20, by the deformation of the coil spring 59 and with the condition that the rack 20 is held by the pinion 26 and rack holding roll 48 and that the pinion 26 is properly held in meshing engagement with the rack 20. Accordingly, the movement of the warp carrying frame structure 5 can be always maintained with high accuracy. Since the pinion drive means 45 is driven and stopped by the clutch mechanism of the clutch brake 41, and particularly since, when the pinion drive means 45 is brought into a stop, it is rapidly braked by the brake of the clutch brake 41, the movement of the warp carrying frame structure 5 also can be enhanced in accuracy. In addition, since the rack 20 can be easily positioned between the pinion 26 and the rack holding roll 48, as previously indicated, and furthermore since the pinion 26 can be surely engaged with the rack 20 only by the actuation of the actuator 50, the replacement of the warp carrying frame structure 5, that is made five to ten times per day, can be very easily made.

Thus, in the present invention, the pinion support 25 is pivoted by means of the actuator 50, the rack 20 is held by the pinion 26 and the rack holding roll 48 with the pinion 26 and rack holding roll 48 having a suitable backlash, and furthermore by the deformation of the coil spring 59, the pinion support 25 is pivoted in accordance with the upward and downward movements of the rack 20 so that the engagement of the pinion 26 with the rack 20 is maintained constant. For this reason, the accuracy of movement of the warp carrying frame structure 5 can be assured independently of the irregularities of the floor 4. As a result, the warp threads are reliably passed through the heddle eye by the warp drawing apparatus 2, and the installation cost for the apparatus can be reduced.

From the foregoing description, it will be seen that, according to the present invention,there is provided an improved warp transfer apparatus in which the accuracy of movement of the warp carrying frame structure is assured independently of the irregularities of the floor and in which the installation cost for the apparatus is reduced.

While a certain representative embodiment and details have been shown for the purpose of illustrating the present invention, it will be apparent to those skilled in this art that various changes and modifications may be made therein without departing from the spirit or scope of the invention.

What we claim is:

1. A warp transfer apparatus for transferring warp threads to a warp drawing apparatus, comprising:

a stationary frame structure, a warp carrying frame structure for carrying the warp threads thereon which is movable with respect to said stationary frame structure and which has mounted thereon a rack extending along a direction in which said warp carrying frame structure moves, a pinion support pivotably supported on said stationary frame structure, a pinion rotatably supported on said pinion support and engageable with said rack, means for driving said pinion to rotate about an axis of rotation of said pinion, the warp carrying frame structure being transferred to a predetermined position of said stationary frame by rotation of said pinion, means for permitting pivotal movement of said pinion support in accordance with upward and downward movements of said rack during movement of said warp carrying frame structure, to insure that said rack is properly engaged by said pinion.

2. A warp transfer apparatus for transferring warp threads to a warp drawing apparatus, comprising:

a stationary frame structure, a warp carrying frame structure for carrying the warp threads thereon which is movable with respect to said stationary frame structure and which has mounted thereon a rack extending along a direction in which said warp carrying frame structure moves, a pinion support pivotably supported on said stationary frame structure, a pinion rotatably supported on said pinion support and engageable with said rack, means for driving said pinion to rotate about an axis of rotation of said pinion, the warp carrying frame structure being transferred to a predetermined position of said stationary frame structure by rotation of said pinion, a lever pivotably supported to said pinion support and having rotatably mounted thereon a roll which is arranged in facing relationship with said pinion, means connected to said pinion support and said lever for pivoting said pinion support and said lever in such a manner that said pinion and said roll are moved toward and away from each other, and an elastic member interposed between said stationary frame structure and said pinion support and for regulating the pivotal movement of said pinion support, the pinion support being pivoted, with said rack held by said pinion and said roll, in accordance with upward and downward movements of said rack by deformation of said elastic member during movement of said warp carrying frame structure.

3. A warp transfer apparatus as set forth in claim 2, further comprising a stop member which is provided between said pinion support and said fixed frame structure and which is adapted to adjust a position in which said pinion support is fixed and held by said elastic member, and control means for controlling actuation of said means for driving said pinion to rotate about an axis of rotation of said pinion.

4. A warp transfer apparatus as set forth in claim 3, in which said control means comprises a photoelectric switch.

5. A warp transfer apparatus as set forth in claim 2, in which said means for pivoting said pinion support and said lever comprises an actuator comprising a cylinder and a piston rod.

6. A warp transfer apparatus as set forth in claim 2, in which said elastic member comprises a spring.

* * * * *